US009964891B2

(12) United States Patent
Anderson et al.

(10) Patent No.: US 9,964,891 B2
(45) **Date of Patent: *May 8, 2018**

(54) SYSTEMS FOR OPTICAL COMMUNICATION BETWEEN AN IMAGE FORMING DEVICE AND A REPLACEABLE UNIT OF THE IMAGE FORMING DEVICE

(71) Applicant: Lexmark International, Inc., Lexington, KY (US)

(72) Inventors: John Douglas Anderson, Lexington, KY (US); Christopher Michael Nelson, Lexington, KY (US); Brian Keith Owens, Lexington, KY (US); Adam Randal Wiedemann, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 103 days.

This patent is subject to a terminal disclaimer.

(21) Appl. No.: 14/573,265

(22) Filed: Dec. 17, 2014

(65) Prior Publication Data

US 2016/0179031 A1 Jun. 23, 2016

(51) Int. Cl.

| | |
|---|---|
| ***G03G 15/08*** | (2006.01) |
| ***B41J 2/175*** | (2006.01) |
| ***G03G 15/00*** | (2006.01) |

(52) U.S. Cl.

CPC ..... *G03G 15/0863* (2013.01); *B41J 2/17503* (2013.01); *B41J 2/17543* (2013.01); *G03G 15/0824* (2013.01); *G03G 15/0827* (2013.01); *G03G 15/0831* (2013.01); *G03G 15/0832* (2013.01); *G03G 15/0849* (2013.01);

(Continued)

(58) Field of Classification Search

CPC ..... G03G 15/0863; G03G 15/0824; G03G 15/0827; G03G 15/0849; G03G 15/0832; G03G 15/0862; G03G 15/0831; G03G 15/0855; G03G 15/556; B41J 2/17543; B41J 2/17503

See application file for complete search history.

(56) References Cited

U.S. PATENT DOCUMENTS 4,768,055 A * 8/1988 Takamatsu ..... G03G 15/0822 399/102
5,038,023 A * 8/1991 Saliga ..... 235/385

(Continued)

OTHER PUBLICATIONS

International Search Report and Written Opinion of the International Searching Authority dated Feb. 12, 2016 for PCT Application No. PCT/US2015/066055.

(Continued)

*Primary Examiner* — Daniel Walsh

(57) ABSTRACT

A replaceable unit for an image forming apparatus according to one example embodiment includes a housing and at least one transmissive member positioned on an exterior of the housing. The at least one transmissive member is arranged to receive optical energy from the image forming apparatus and has a transmissivity for modifying an amount of the optical energy that leaves the at least one transmissive member relative to an amount of the optical energy received by the at least one transmissive member. The at least one transmissive member indicates information relating to a characteristic of the replaceable unit.

20 Claims, 12 Drawing Sheets

(52) U.S. Cl.
CPC ..... *G03G 15/0855* (2013.01); *G03G 15/0862* (2013.01); *G03G 15/556* (2013.01)

(56) References Cited

U.S. PATENT DOCUMENTS 5,352,879 A * 10/1994 Milch ..... 235/462.05
5,596,388 A * 1/1997 Ohkubo et al. ..... 399/111
5,659,847 A 8/1997 Tsuda et al.
5,745,822 A * 4/1998 Nishimura ..... G03G 15/0882 399/102
5,758,224 A * 5/1998 Binder ..... G03G 15/553 399/25
5,987,269 A * 11/1999 Allen ..... G03G 15/086 399/27
5,999,759 A * 12/1999 Palumbo ..... G03G 15/0855 399/262
6,002,898 A * 12/1999 Yokomori ..... G03G 15/0126 399/103
6,032,002 A * 2/2000 Yokomori ..... G03G 15/0126 399/114
6,234,603 B1 * 5/2001 Altfather ..... B41J 2/17513 347/19
6,240,262 B1 * 5/2001 Taniyama ..... G03G 15/0863 399/12
6,256,467 B1 * 7/2001 Yokomori ..... G03G 15/0126 399/119
6,285,024 B1 9/2001 Plnnock
6,293,143 B1 * 9/2001 Denton ..... B41J 2/17566 250/227.11
6,299,274 B1 * 10/2001 Bolash et al. ..... 347/19
7,283,755 B2 * 10/2007 Ishiguro ..... G03G 15/0856 399/27
7,480,472 B2 1/2009 Williams et al.
7,559,635 B2 7/2009 Conway et al.
7,734,197 B2 * 6/2010 Sato ..... G03G 15/0863 399/12
8,096,646 B2 1/2012 Hattori et al.
8,985,442 B1 * 3/2015 Zhou ..... G06Q 30/02 235/375
9,519,254 B2 * 12/2016 Anderson ..... G03G 21/1878
2001/0001025 A1 * 5/2001 Nakajima ..... G03G 21/12 399/120
2002/0024543 A1 * 2/2002 Kimura ..... B41J 2/17509 347/7
2002/0034402 A1 * 3/2002 Hosoya ..... G03G 15/0152 399/237
2002/0038222 A1 * 3/2002 Naka ..... 705/1
2002/0140757 A1 * 10/2002 Tullis ..... B41J 2/2135 347/19
2003/0040984 A1 * 2/2003 Inami et al. ..... 705/27
2003/0063914 A1 * 4/2003 Masuda ..... H04N 1/295 399/12
2004/0201861 A1 * 10/2004 Ishibashi ..... G03G 15/0863 358/1.1
2004/0218024 A1 * 11/2004 Hankins ..... B29C 65/1435 347/86
2004/0218934 A1 * 11/2004 Silverbrook ..... B41J 2/14 399/12
2004/0264984 A1 * 12/2004 Yabuki ..... G03G 15/0889 399/27
2005/0035985 A1 * 2/2005 Taguchi et al. ..... 347/7
2005/0068389 A1 * 3/2005 Katayama ..... B41J 2/17513 347/86
2005/0078969 A1 4/2005 Kikuchi
2005/0162490 A1 * 7/2005 Katayama ..... B41J 2/17503 347/86
2005/0195225 A1 * 9/2005 Takagi ..... B41J 2/17513 347/7
2005/0219333 A1 * 10/2005 Yuen ..... B41J 2/17506 347/85
2005/0254831 A1 * 11/2005 Soga ..... G03G 15/50 399/12
2005/0254832 A1 * 11/2005 Kumai ..... G03G 15/0863 399/12
2006/0044577 A1 * 3/2006 Weast et al. ..... 358/1.9
2006/0164482 A1 * 7/2006 Katayama ..... B41J 2/17509 347/86
2006/0222383 A1 * 10/2006 Mukataka ..... G03G 15/556 399/27
2007/0070137 A1 * 3/2007 Hattori ..... B41J 2/17513 347/86
2007/0236546 A1 * 10/2007 Sugahara ..... B41J 2/17566 347/86
2008/0018720 A1 * 1/2008 Fukushima ..... B41J 2/17513 347/86
2008/0025735 A1 * 1/2008 Odani ..... G03G 15/0863 399/12
2008/0121727 A1 * 5/2008 Iftime ..... G06K 1/12 235/494
2009/0128794 A1 * 5/2009 Matsuyama ..... H03K 17/941 355/67
2009/0314837 A1 * 12/2009 Kataoka ..... G03G 15/553 235/385
2010/0143001 A1 * 6/2010 Chuang ..... G03G 15/0855 399/262
2010/0150580 A1 * 6/2010 Brumbaugh et al. ..... 399/16
2010/0265305 A1 * 10/2010 Qin ..... B41J 2/17566 347/86
2010/0284047 A1 * 11/2010 Ota ..... H04N 1/00795 358/475
2011/0123237 A1 * 5/2011 Kudo ..... G03G 15/161 399/313
2012/0002987 A1 * 1/2012 Odani ..... G03G 15/50 399/44
2012/0099886 A1 * 4/2012 Kim ..... G03G 15/04045 399/98
2012/0237232 A1 * 9/2012 Goto ..... G03G 15/0194 399/49
2013/0083142 A1 * 4/2013 Minamikawa et al. ..... 347/86
2013/0170867 A1 7/2013 Acosta et al.
2013/0222461 A1 * 8/2013 Kaszynski ..... B41J 2/2128 347/19
2016/0179031 A1 * 6/2016 Anderson ..... G03G 15/556 399/12

OTHER PUBLICATIONS

U.S. Appl. No. 14/735,266, filed Jun. 10, 2015.
U.S. Appl. No. 14/573,290, filed Dec. 17, 2014.

* cited by examiner

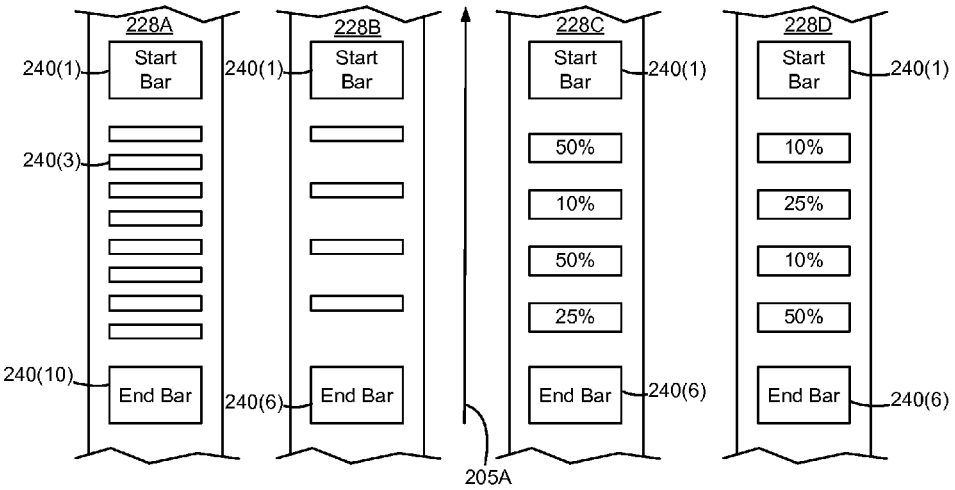
FIGURE 12A
FIGURE 12B
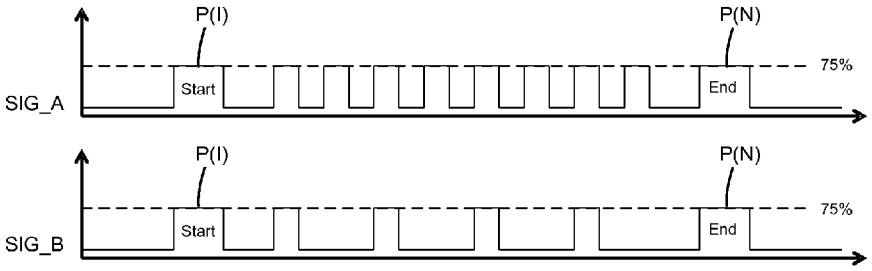
FIGURE 13A
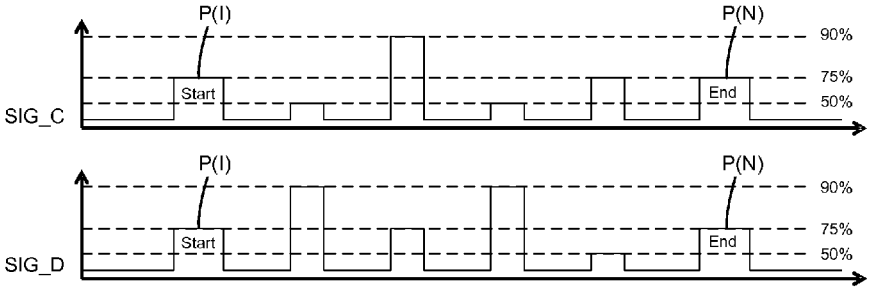
FIGURE 13B

SYSTEMS FOR OPTICAL COMMUNICATION BETWEEN AN IMAGE FORMING DEVICE AND A REPLACEABLE UNIT OF THE IMAGE FORMING DEVICE

CROSS REFERENCES TO RELATED APPLICATIONS

None.

BACKGROUND

1. Field of the Disclosure

The present disclosure relates generally to image forming devices and more particularly to a replaceable unit of an image forming device and optical communication therebetween to provide information relating to characteristics of the replaceable unit to the image forming device.

2. Description of the Related Art

Image forming devices such as electrophotographic printers, copiers and multifunction devices commonly include one or more replaceable units that have a shorter lifespan than the image forming device does. As a result, the replaceable unit must be replaced by the user from time to time in order to continue operating the image forming device. For example, an electrophotographic image forming device's toner supply is typically stored in one or more replaceable units. In some devices, imaging components having a longer life are separated from those having a shorter life in separate replaceable units. In this configuration, relatively longer life components such as a developer roll, a toner adder roll, a doctor blade and a photoconductive drum may be positioned in one or more replaceable units referred to as imaging units. The image forming device's toner supply, which is consumed relatively quickly in comparison with the components housed in the imaging unit(s), may be provided in a reservoir in a separate replaceable unit in the form of a toner cartridge or bottle that supplies toner to one or more of the imaging unit(s). Other components of the electrophotographic image forming device such as a fuser may also be replaceable. These replaceable units require periodic replacement by the user such as when the toner cartridge runs out of usable toner, when a replaceable unit's components reach the end of their life due to wear, when a waste toner reservoir fills with waste toner, etc.

When installed, replaceable units generally communicate certain information to the image forming device for proper operation. Toner cartridges, for example, communicate with the image forming device particular characteristics such as toner type, color, and capacity, and/or other settings/information associated therewith. Typically, this information is communicated to the image forming device using smart chips and/or memory devices that are mounted on the housing of the toner cartridge. The image forming device, in turn, identifies the toner cartridge using the information received therefrom. While using smart chips and/or memory devices have been met with success in terms of effectively storing and communicating information associated with replaceable units, alternative means for communication between replaceable units and the image forming device is desired.

SUMMARY

A replaceable unit for an image forming apparatus according to one example embodiment includes a housing and at least one transmissive member positioned on an exterior of the housing. The at least one transmissive member is arranged to receive optical energy from the image forming apparatus and has a transmissivity for modifying an amount of the optical energy that leaves the at least one transmissive member relative to an amount of the optical energy received by the at least one transmissive member. The at least one transmissive member indicates information relating to a characteristic of the replaceable unit.

A container for ink or toner for an image forming device according to another example embodiment includes a housing having a reservoir for holding ink or toner. At least one member is positioned on an exterior of the housing. The at least one member has a transmissive region that is unobstructed and positionable in an optical path of an optical sensor of the image forming device when the container is installed therein. The transmissive region has a transmissivity for changing an amount of optical energy received by a receiver of the optical sensor relative to an amount of optical energy emitted by a transmitter of the optical sensor. A characteristic of the container is encoded in the transmissivity of the transmissive region and is detectable by the image forming device based on the amount of the optical energy received by the receiver.

A system for determining at least one characteristic of a replaceable unit installable in an image forming device according to another example embodiment includes an optical sensor including a transmitter that emits optical energy along an optical path and a receiver positioned to receive the optical energy. At least one transmissive member is positioned on an exterior of a housing of the replaceable unit. The at least one transmissive member is positioned in the optical path when the replaceable unit is installed in the image forming device and has a transmissivity that changes an amount of the optical energy received by the receiver relative to an amount of the optical energy emitted by the transmitter. A controller is communicatively coupled to the optical sensor and is operative to determine at least one characteristic of the replaceable unit based on the amount of the optical energy received by the receiver.

A system for determining at least one characteristic of a replaceable unit installable in an image forming device according to another example embodiment includes an optical sensor including a transmitter that emits optical energy along an optical path and a receiver positioned to receive the optical energy. At least one reflective member is positioned on an exterior of a housing of the replaceable unit. The at least one reflective member is positioned in the optical path when the replaceable unit is installed in the image forming device and has a reflectivity for reflecting a fraction of the optical energy emitted by the transmitter towards the receiver. An amount of the reflectivity of the at least one reflective member indicates information relating to a characteristic of the replaceable unit.

BRIEF DESCRIPTION OF THE DRAWINGS

The accompanying drawings incorporated in and forming a part of the specification, illustrate several aspects of the present disclosure, and together with the description serve to explain the principles of the present disclosure.

FIGS. 12A-12B illustrate the positioning guide including a plurality of transmissive members.

FIGS. 13A-13B are diagrams illustrating example signal patterns generated when corresponding transmissive members in FIGS. 12A-12B move into an optical path of the optical sensor.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
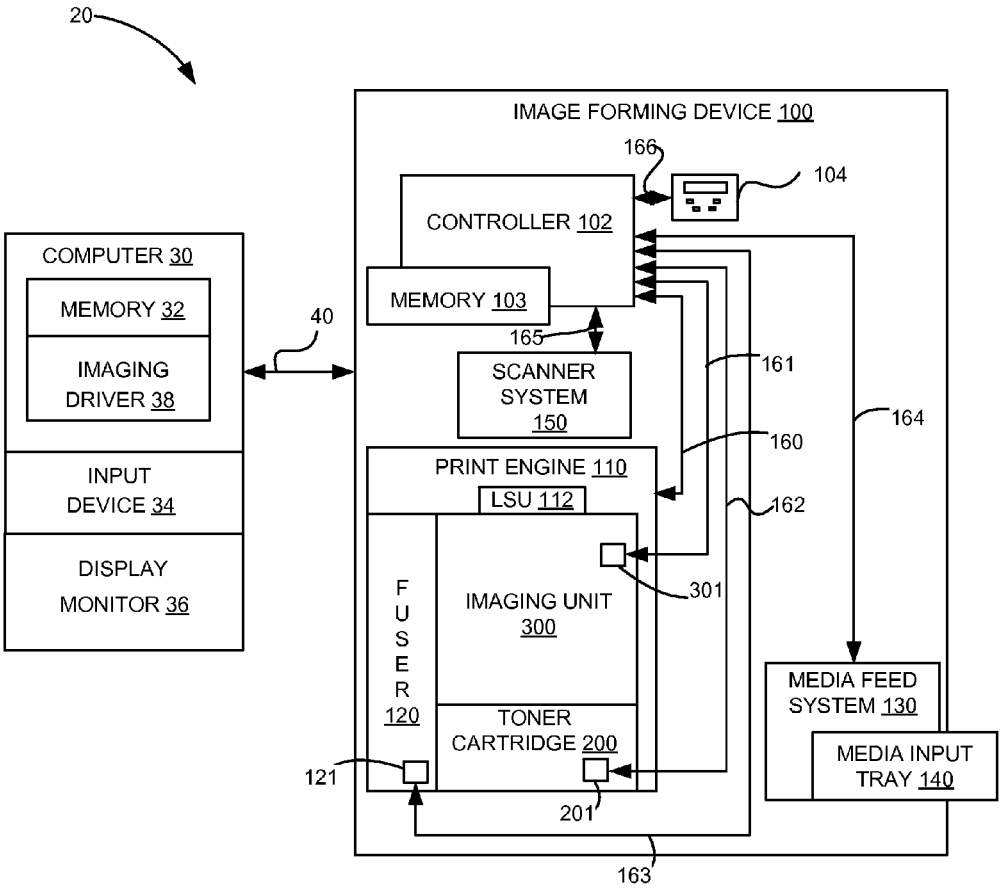
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
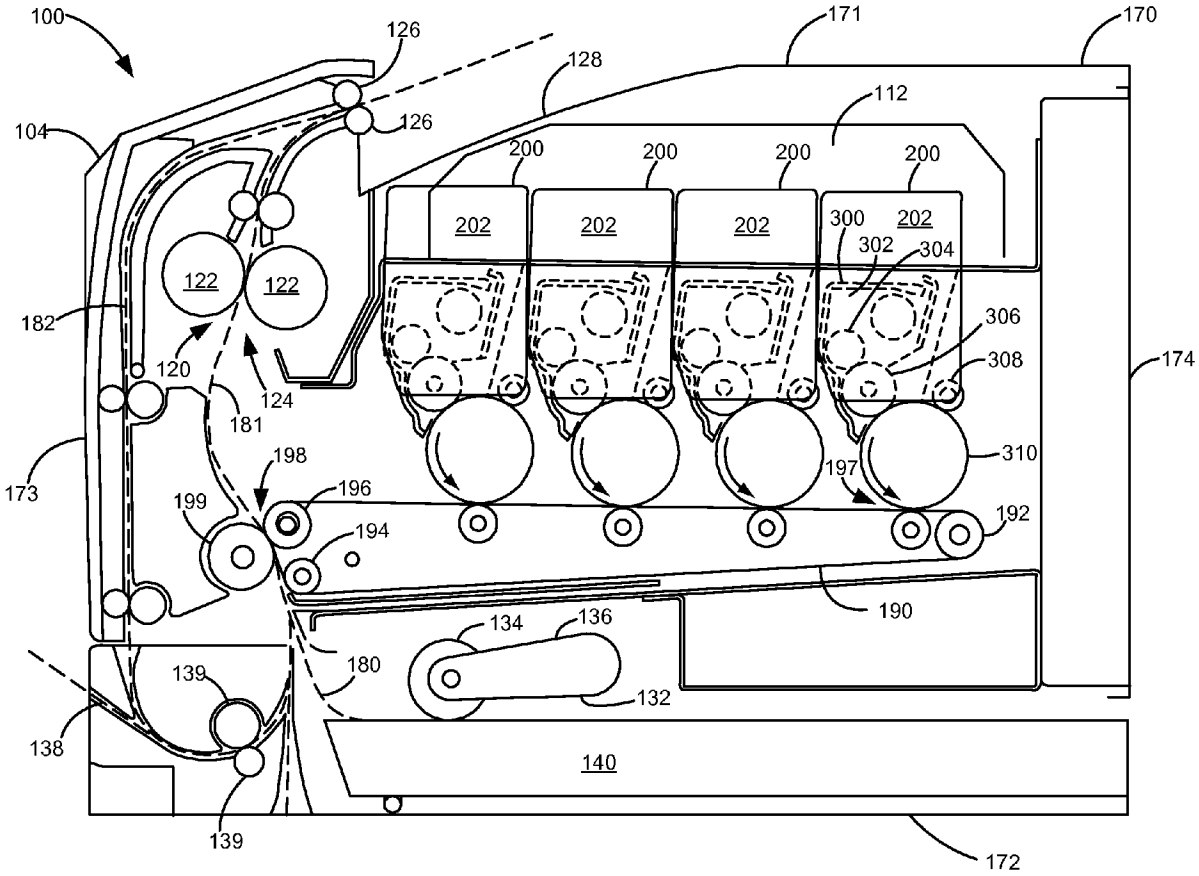
FIG. 2 is a schematic diagram of an image forming device according to a first example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 include yellow, cyan, magenta and black toner. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
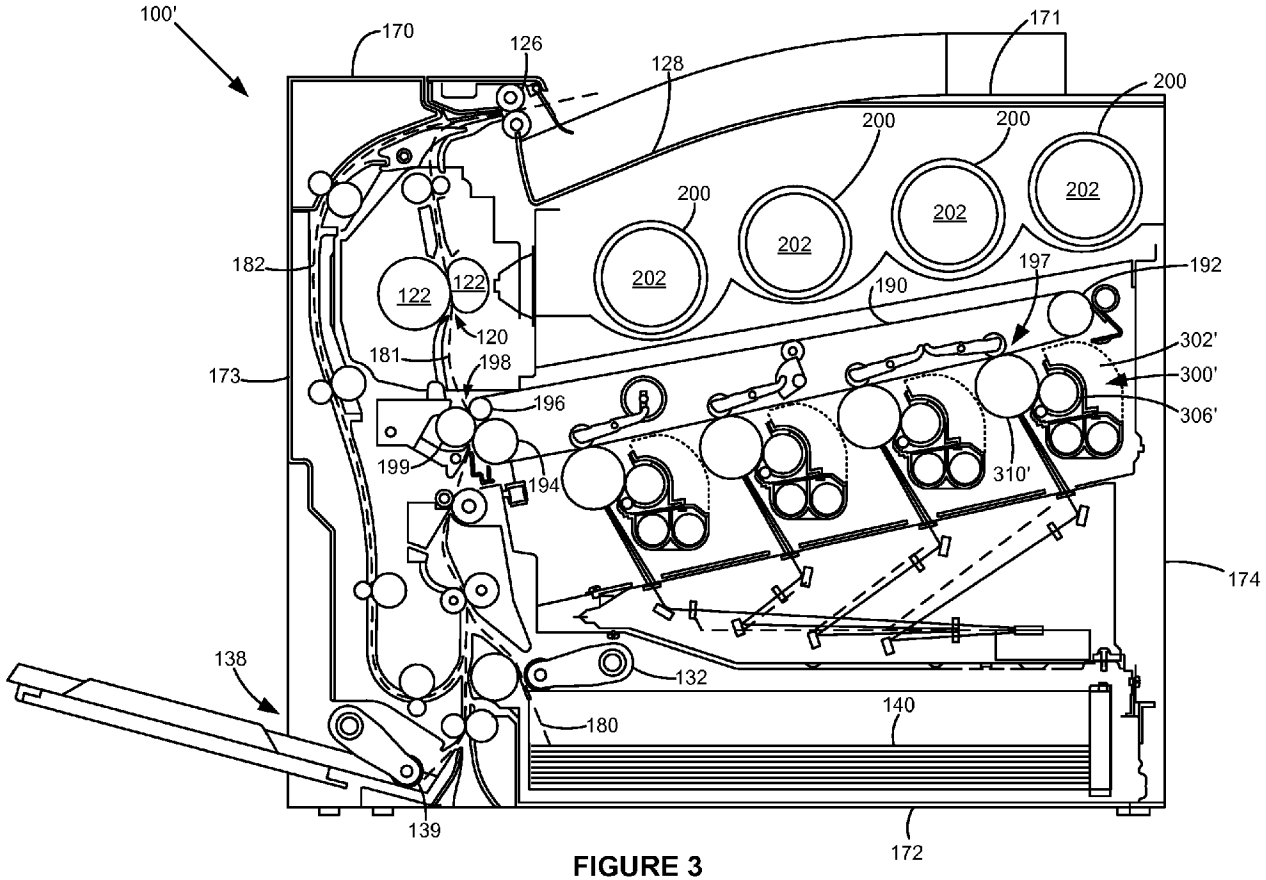
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although image forming devices 100 and 100' utilize ITM 190 to transfer toner to the media, toner may be applied directly to the media by the one or more photoconductive drums 310, 310' as is known in the art. In addition, toner may be transferred directly from each toner cartridge 200 to its corresponding imaging unit 300 or 300' or the toner may pass through an intermediate component such as a chute, duct or hopper that connects the toner cartridge 200 with its corresponding imaging unit 300 or 300'.

Figure 4:
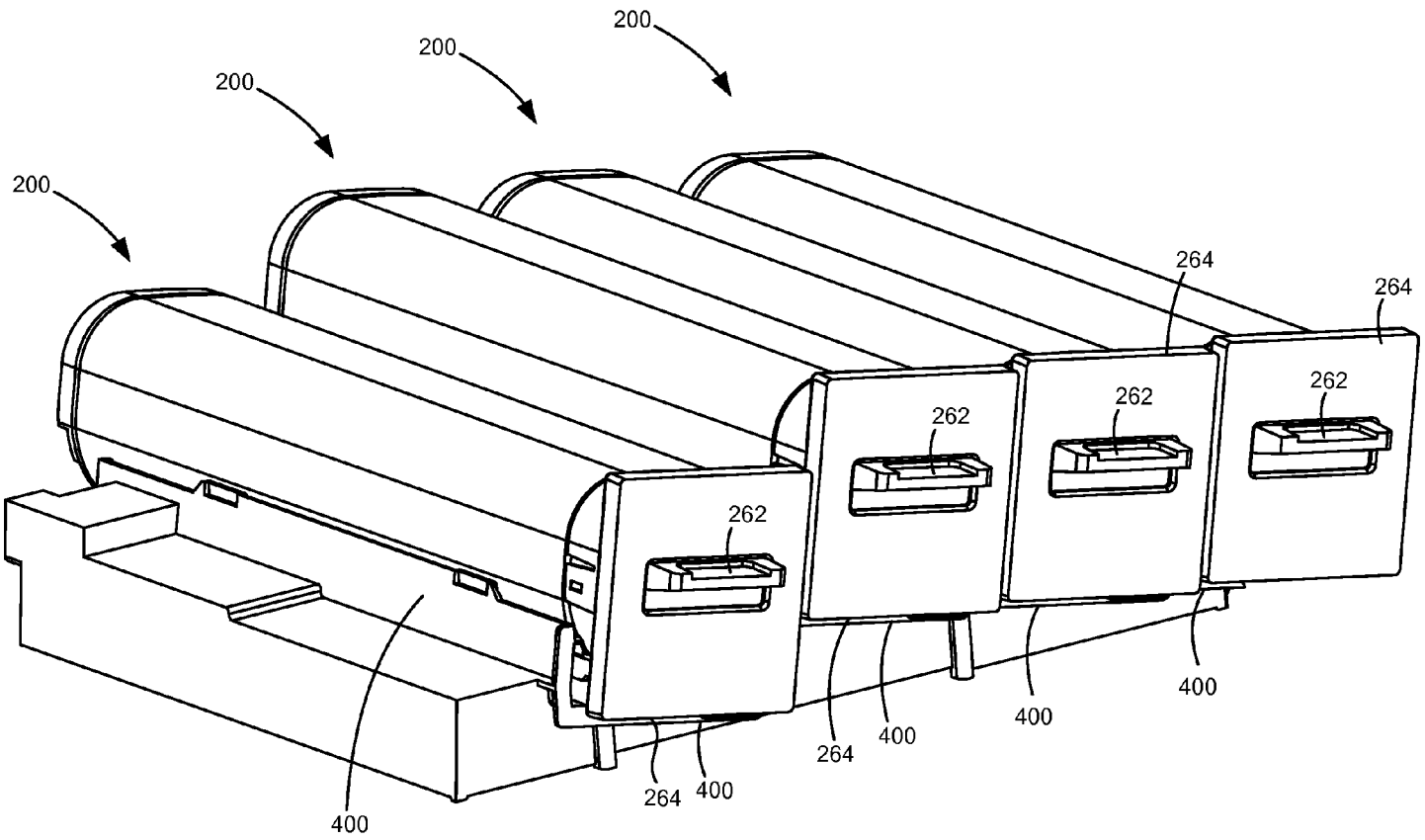
FIG. 4 is a perspective view of four toner cartridges positioned in four corresponding trays according to one example embodiment.

With reference to FIG. 4, four toner cartridges 200 are shown positioned in four corresponding trays 400 in image forming device 100, 100' according to one example embodiment. In the example embodiment shown, trays 400 are formed from a unitary element; however, trays 400 may be formed from separate elements mounted together as desired. Trays 400 are mounted in a stationary position within housing 170 of image forming device 100, 100'. In the example embodiment shown, the vertical positions of trays 400 and toner cartridges 200 vary; however, the positioning of the toner cartridges 200 relative to each other is a matter of design choice. Each toner cartridge 200 is independently insertable into and removable from its corresponding tray 400 in order to permit a user to individually remove and replace each toner cartridge 200 when it runs out of usable toner. A handle 262 extends from a front 264 of each toner cartridge 200 and provides a handhold for the user for inserting or removing each toner cartridge 200 from its corresponding tray 400.

Figure 5:
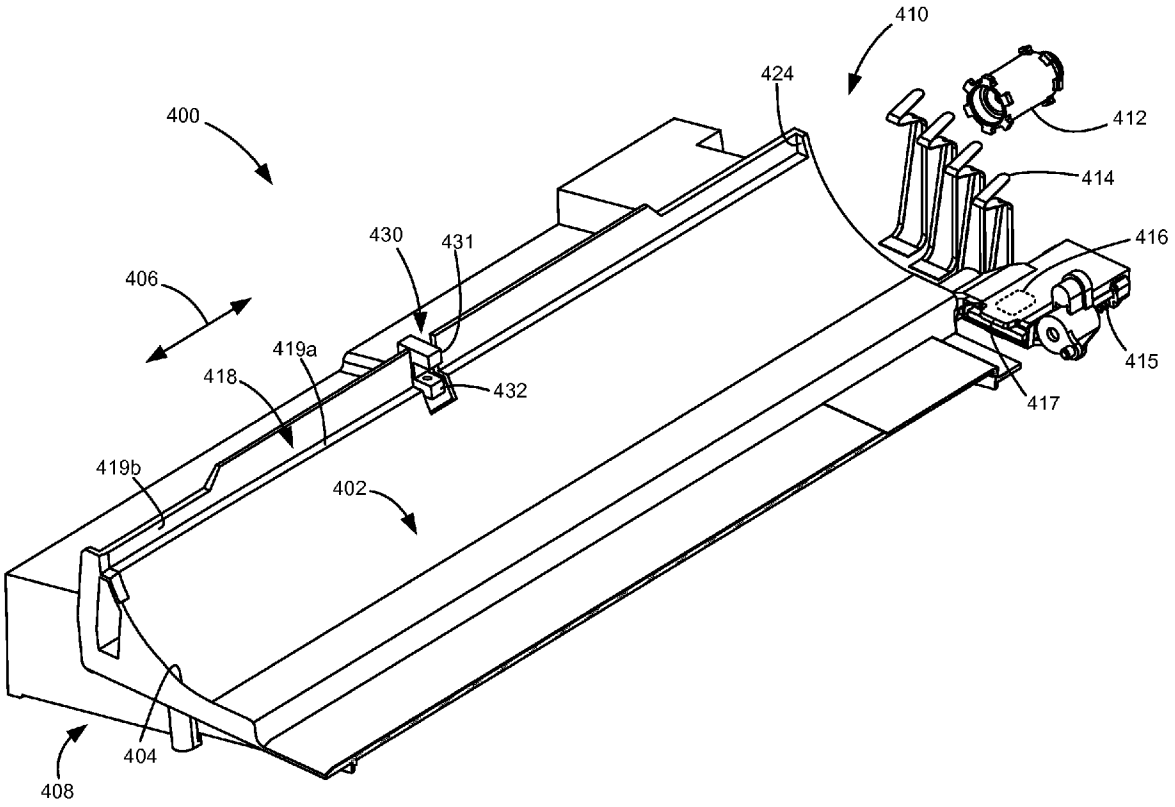
FIG. 5 is a perspective view of one of the trays shown in FIG. 4 with the corresponding toner cartridge removed.

FIG. 5 shows a portion of one of the trays 400 with the corresponding toner cartridge 200 removed. Tray 400 includes a cartridge storage area 402 that is sized and shaped to hold the corresponding toner cartridge 200. Cartridge storage area 402 is defined by a top surface 404 that generally conforms to the shape of the exterior of the lower portion of toner cartridge 200 including the bottom and sides of toner cartridge 200. Cartridge storage area 402 extends along a lengthwise dimension 406 and is open at a front end 408 to permit the insertion and removal of the corresponding cartridge 200 into and out of cartridge storage area 402. Front end 408 is accessible to a user upon opening one or more access doors or panels on housing 170 of image forming device 100, 100'. A rear end 410 of cartridge storage area 402 includes a drive element 412, such as a gear or other form of drive coupler, positioned to engage a corresponding drive element on toner cartridge 200 in order to provide rotational power to rotating components of toner cartridge 200 such as toner agitators in reservoir 202. Rear end 410 also includes one or more electrical contacts 414 that mate with corresponding electrical contacts of toner cartridge 200 in order to facilitate communications link 162 between processing circuitry 201 on toner cartridge 200 and controller 102 of image forming device 100, 100'. A toner inlet port 416 is positioned near rear end 410 of cartridge storage area 402. Inlet port 416 is positioned to receive toner from a corresponding outlet port of toner cartridge 200. Inlet port 416 may be a component of imaging unit 300, 300' or an intermediate component such as a chute, duct or hopper that permits toner flow from toner cartridge 200 to its corresponding imaging unit 300, 300'. In one embodiment, a shutter 417 is positioned above inlet port 416 and is slidably movable between an open position and a closed position. In the open position, shutter 417 permits toner to flow into inlet port 416. In the closed position, shutter 417 blocks inlet port 416 to prevent toner from leaking out of inlet port 416 when toner cartridge 200 is absent from tray 400. Shutter 417 is biased toward the closed position blocking inlet port 416 such as, for example, by one or more extension springs 415. In the example embodiment illustrated, shutter 417 slides toward front end 408 when shutter 417 moves from the open position to the closed position and toward rear end 410 when shutter 417 moves from the closed position to the open position.

Tray 400 includes alignment features that position toner cartridge 200 relative to drive element 412, electrical contacts 414 and inlet port 416. Tray 400 includes a pair of loading rails 418, 420 (FIG. 9) running along lengthwise dimension 406 of cartridge storage area 402 between front end 408 and rear end 410. Loading rails 418, 420 are positioned at opposite sides of cartridge storage area 402 to engage opposite sides of the toner cartridge 200 installed therein. Each loading rail 418, 420 includes a top rail surface 419*a*, 421*a* (FIG. 9) on which a positioning guide of toner cartridge 200 may rest. Each loading rail 418, 420 also includes an outer side restraint 419*b*, 421*b* (FIG. 9) that limits the side-to-side motion of toner cartridge 200 in cartridge storage area 402. Each loading rail 418, 420 is open at front end 408 in order to permit toner cartridge 200 to be inserted and removed at front end 408. A stop 424 is positioned at rear end 410 of each loading rail 418, 420 to prevent over-insertion of toner cartridge 200 into tray 400. In the example embodiment illustrated, each stop 424 includes a generally vertical wall extending upward at rear end 410 of loading rails 418, 420. Tray 400 may also include one or more latch mechanisms (not shown) that retain toner cartridge 200 in its final operating position in tray 400.

Figure 6:
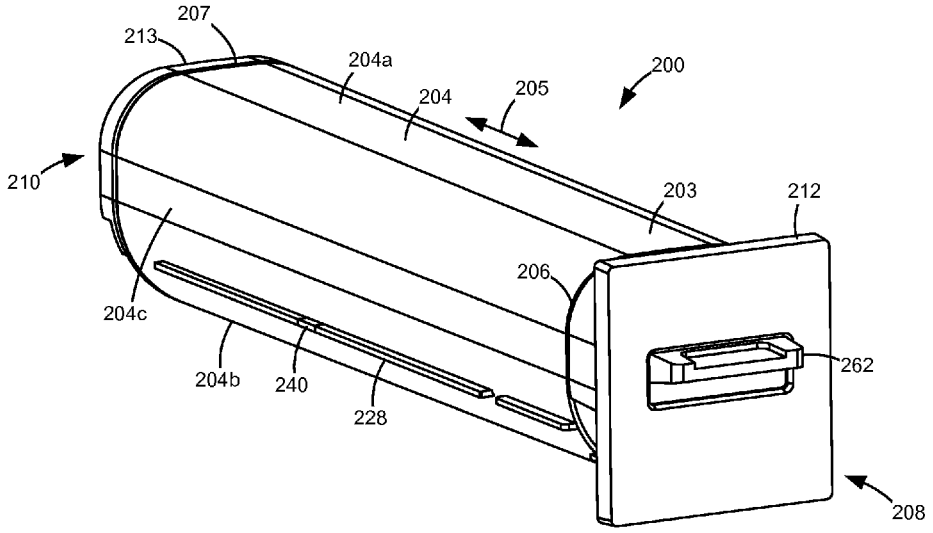
FIG. 6 is a front perspective view of one of the toner cartridges shown in FIG. 4.
Figure 7:
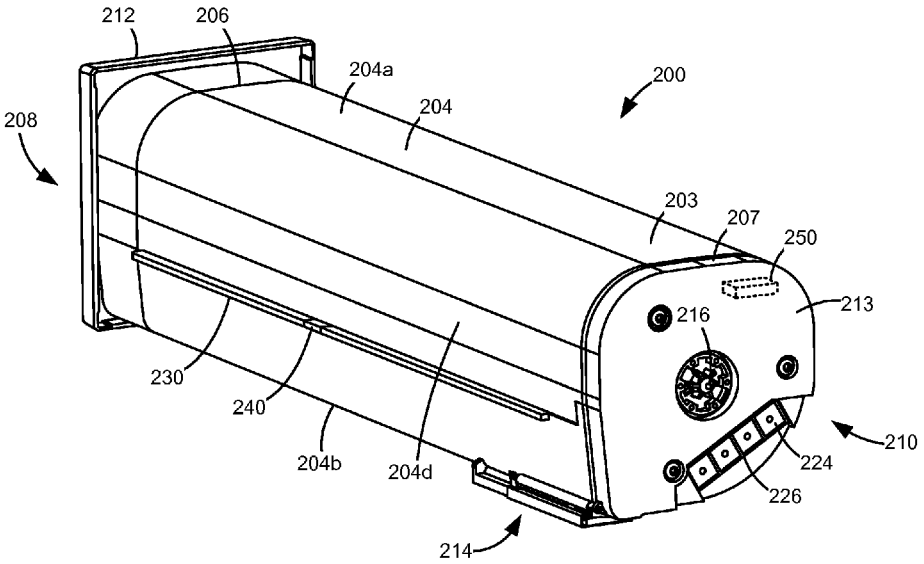
FIG. 7 is a rear perspective view of the toner cartridge shown in FIG. 6.

FIGS. 6-7 show toner cartridge 200 according to one example embodiment. Toner cartridge 200 includes an elongated body or housing 203 that includes walls forming toner reservoir 202 (FIGS. 2 and 3). In the example embodiment illustrated, housing 203 includes a generally cylindrical wall 204 that extends along a lengthwise dimension 205 and a pair of end walls 206, 207 defining a front end 208 and a rear end 210, respectively, of toner cartridge 200. Wall 204 includes a top 204*a*, bottom 204*b* and sides 204*c*, 204*d*. In the embodiment illustrated, end caps 212, 213 are mounted on end walls 206, 207, respectively, such as by suitable fasteners (e.g., screws, rivets, etc.) or by a snap-fit engagement. An outlet port 214 is positioned on bottom 204*b* of housing 203 near end wall 207. Toner is periodically delivered from reservoir 202 through outlet port 214 to inlet port 416 to refill reservoir 302 of imaging unit 300, 300' as toner is consumed by the printing process. Toner cartridge 200 includes one or more agitators (e.g., paddles, augers, etc.) to stir and move toner within reservoir 202 toward outlet port 214. In the example embodiment illustrated, a drive element 216, such as a gear or other form of drive coupler, is positioned on an outer surface of end wall 207. Drive element 216 is positioned to engage corresponding drive element 412 when toner cartridge 200 is installed in tray 400 in order to receive rotational power to drive the agitator(s) in reservoir 202. The agitator(s) within reservoir 202 may be connected directly or by one or more intermediate gears to drive element 216.

Toner cartridge 200 also includes one or more electrical contacts 224 positioned on the outer surface of end wall 207. Electrical contacts 224 are positioned generally orthogonal to lengthwise dimension 205. In one embodiment, electrical contacts 224 are positioned on a printed circuit board 226 that also includes processing circuitry 201 (FIG. 1). Processing circuitry 201 may provide authentication functions, safety and operational interlocks, operating parameters and usage information related to toner cartridge 200. Electrical contacts 224 are positioned to contact corresponding electrical contacts 414 when toner cartridge 200 is installed in tray 400 in order to facilitate communications link 162 with controller 102. Positioning guides 228, 230 (e.g., wings or ribs) are provided on each side 204*c*, 204*d* of wall 204 of toner cartridge 200. Positioning guides 228, 230 extend along lengthwise dimension 205 between front end 208 and rear end 210 to assist with the insertion and removal of toner cartridge 200 into tray 400. It should be appreciated that the structure and insertion method of toner cartridge 200 is presented for purposes of illustration and should not be considered limiting. Thus, it is contemplated that toner cartridge 200 may take a variety of shapes and may be installed in image forming device 100 using different installation methods such as by vertical downward insertion or rotational movement.

In accordance with example embodiments of the present disclosure, toner cartridge 200 includes one or more optical members or optically readable features that are used to provide information relating to one or more properties or characteristics of the toner cartridge 200 bearing the optically readable feature(s). In general, an optically readable feature exhibits optical characteristics or properties that are directly or indirectly correlated with characteristics associated with toner cartridge 200 to provide information relating thereto. Example optical properties may include, but are not limited to, transmissivity and reflectivity which allow the optically readable feature to transmit and/or reflect optical energy directed to it. Characteristics associated with toner cartridge 200 may include, but are not limited to, toner type/color, and cartridge type/size/capacity. In other example embodiments, the optically readable features may also be used to convey other information about toner cartridge 200 such as, for example, shipment geography, country of origin (manufacture), time of manufacture, and other information relating to toner cartridge 200. Optical energy transmitted or reflected by the optically readable feature can be detected and used by image forming device 100 to identify information associated with toner cartridge 200, as will be explained in greater detail below. The optically readable feature is typically positioned on an exterior of housing 203 and is readable by an optical sensor of image forming device 100 when toner cartridge 200 is installed therein.

In the embodiment illustrated in FIG. 6, an optically readable transmissive member 240 is located along positioning guide 228. Location of transmissive member 240 corresponds to a location of an optical sensor 430 (FIG. 5) positioned along loading rail 418 of tray 400 such that transmissive member 240 is readable by optical sensor 430 upon insertion of toner cartridge 200 into tray 400. Additionally or in the alternative, transmissive member 240 may be disposed along opposed positioning guide 230, as shown in FIG. 7, and readable by a corresponding optical sensor positioned along loading rail 420 of tray 400.

Transmissive member 240 generally includes a transmissive region having a characteristic transmissivity for changing an amount of optical energy received by a receiver of optical sensor 430 relative to an amount of optical energy emitted by a transmitter thereof. In one example, the transmissive region may be constructed of a material having a substantially transmissive base material, such as polycarbonate, and additives that modify opacity and transmissivity thereof. In another example, transmissivity may be modified by varying the thickness of the transmissive member 240. In still another example, the transmissive member 240 may have a textured surface that can cause scattering and/or reflection of incident optical energy emitted by the optical sensor transmitter and, thus, less energy reaching the receiver. As will be appreciated, transmissivity of the transmissive region may be modified to block optical energy using different combinations of scattering, diffusion, reflection, absorption, diffraction or other mechanisms as are known in the field of optics and electromagnetics.

In one example embodiment, transmissive member 240 may be integrally formed as a unitary piece with positioning guide 228. In one example, positioning guide 228 may be molded having translucent and opaque regions, with the translucent region forming transmissive member 240. In another example, positioning guide 228 may be provided as a translucent or transparent member, and transmissive member 240 may be achieved by varying the transmissivity of a portion of positioning guide 228 using different techniques as discussed above. For example, a coating or sticker may be applied to the translucent or transparent member to modify the transmissivity of the member.

Figure 8:
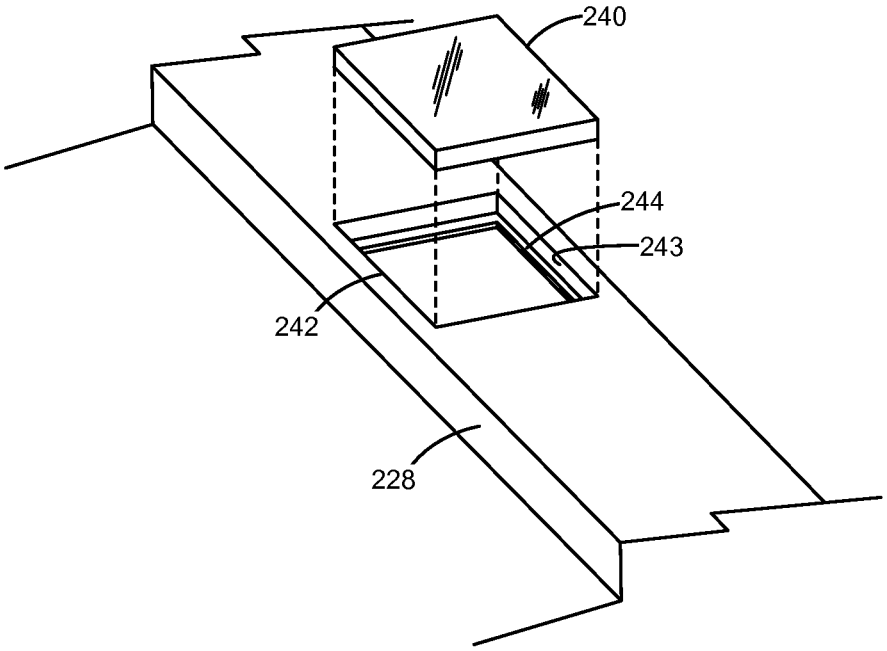
FIG. 8 illustrates a transmissive member insertable on a positioning guide of the toner cartridge shown in FIG. 6.

In another example embodiment, the transmissive member 240 may be implemented as an insert to positioning guide 228. For example, with reference to FIG. 8, transmissive member 240 is insertable into an aperture 242 formed on positioning guide 228 of toner cartridge 200. In the illustrated embodiment, aperture 242 includes interior walls 243 that form a frame having a size that allows transmissive member 240 to fit closely into aperture 242. Ledges 244 are formed near the bottom of interior walls 243 such that when transmissive member 240 is inserted into aperture 242, transmissive member 240 rests in contact and on top of ledges 244. Additionally, transmissive member 240 may be adhesively attached to interior walls 243 and/or ledges 244 to hold transmissive member 240 in place on positioning guide 228.

Referring back to FIG. 5, optical sensor 430 includes a transmitter 431 and a receiver 432 positioned along loading rail 418. Although optical sensor 430 is shown being disposed about a longitudinal center of loading rail 418, it is understood that optical sensor 430 may be disposed at other locations along loading rail 418 so as to be able to read transmissive member 240 upon insertion of toner cartridge 200 in tray 400. Transmitter 431 emits electromagnetic or optical energy, which may consist of visible light or near-visible energy (e.g., infrared or ultraviolet), that is detectable by receiver 432. Transmitter 431 may be embodied as an LED, a laser diode, or any other suitable device for generating optical energy. Receiver 432 may be implemented as a photodetector, such as a photodiode, PIN diode, phototransistor, or other devices capable of converting optical energy into an electrical signal. In the embodiment illustrated, a top surface of receiver 432 is substantially flush along the top rail surface 419*a* and transmitter 431 is spaced above receiver 432. Alternatively, reverse arrangement between transmitter 431 and receiver 432 may be applied. Transmitter 431 emits optical energy along an optical path and receiver 432 receives the optical energy from transmitter 431.

Figure 9:
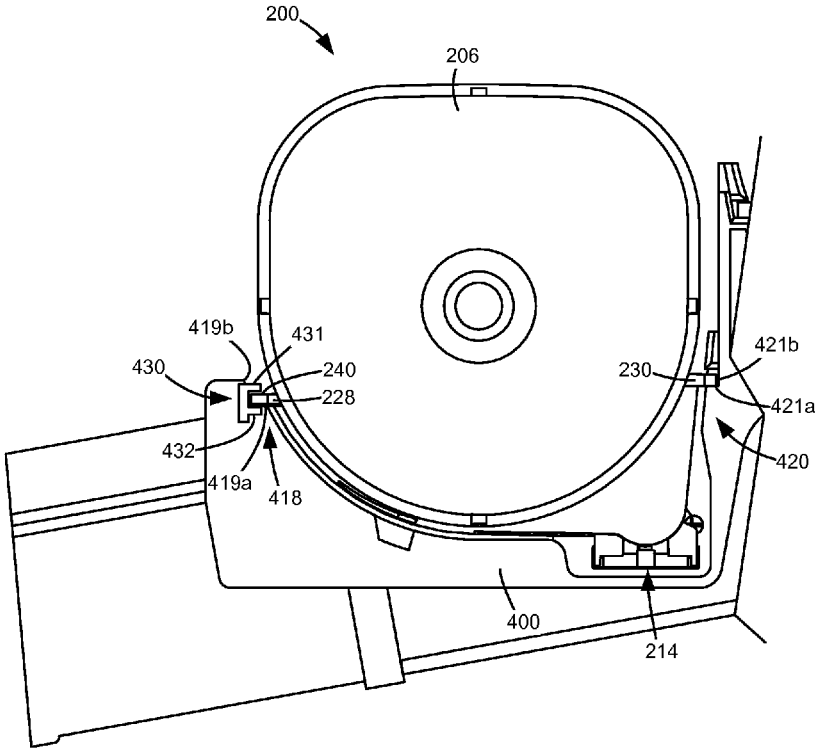
FIG. 9 is a front elevation view of the toner cartridge installed in the tray according to one example embodiment.
Figure 10:
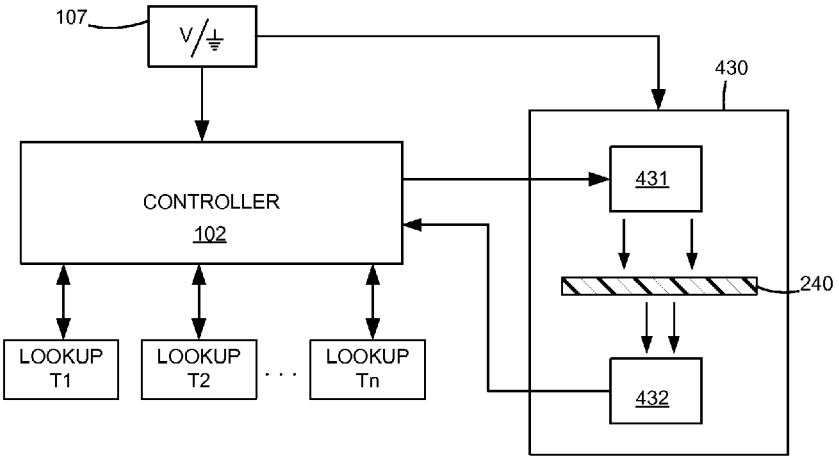
FIG. 10 is a block diagram illustrating communication between a controller and an optical sensor of the image forming device according to one example embodiment.

Referring to FIG. 9, toner cartridge 200 is shown positioned in tray 400 with positioning guides 228, 230 resting on top of loading rails 418, 420 and transmissive member 240 positioned between transmitter 431 and receiver 432 of optical sensor 430. In FIG. 10, controller 102 is shown coupled to optical sensor 430 and is configured to communicate therewith to control activation of transmitter 431 and receive signals from receiver 432. Additional circuitries on board may also be used to convert signals into forms suitable for use by controller 102 and/or optical sensor 430. In operation, controller 102 generates a signal for driving transmitter 431 to emit optical energy and receiver 432 generates an output signal based on the amount of optical energy it receives. As transmissive member 240 is positioned along the optical transmission path between transmitter 431 and receiver 432, it operates as an interrupter of sorts which blocks at least some fraction of the optical energy emitted by transmitter 431 that is incident on transmissive member 240 and allows at least some fraction of the optical energy incident on transmissive member 240 to pass therethrough and reach receiver 432. Signals that are output by receiver 432 based on the optical energy it receives are received and analyzed by controller 102, or other associated processing circuitries, to determine transmissivity of transmissive member 240. Raw data by optical sensor 430 may be converted to discrete digital values. For example, data obtained from optical sensor 430 may be encoded into one of a plurality of discrete values corresponding to a transmissivity value.

In an example embodiment, controller 102 accesses a lookup table T1, which includes a plurality of stored transmissivity values and corresponding toner cartridge characteristics associated therewith, to cross-reference the detected transmissivity for a stored transmissivity value correlated with a particular toner cartridge characteristic. Lookup table T1 may be stored in memory 103 of image forming device 100. Alternatively, lookup table T1 may be stored remotely over the Internet or in the cloud on a server, a USB drive, an external hard drive, or other storage location external to image forming device 100. An example lookup table showing transmissivity values (in terms of percentage) and corresponding characteristics, is illustrated in Table 1.

TABLE 1

| Transmissivity and Characteristic | |
|---|---|
| Transmissivity Range | Toner Cartridge Characteristic |
| 5%-20% | Cyan |
| 30%-45% | Magenta |
| 55%-70% | Yellow |
| 80%-95% | Black |

As shown, Table 1 includes a plurality of table records. Each table record includes a predetermined transmissivity range and a corresponding toner cartridge characteristic. The predetermined transmissivity range corresponds to a range of transmissivity values within which transmissivity of a transmissive member being read may fall, and the corresponding characteristic indicates characteristic information related to the toner cartridge. The toner cartridge characteristics, in this example, include color types of a toner cartridge including cyan, magenta, yellow, and black. Accordingly, a color type of toner cartridge 200 can be determined if transmissivity of the transmissive member of such toner cartridge 200 is known. As an example, if a transmissivity value of about 40% for a transmissive member 240 is detected, then the toner cartridge 200 bearing the transmissive member 240 can be identified as having magenta color. As a result, the lookup table in Table 1 provides a reference for determining a color characteristic of the toner cartridge 200 using transmissivity values. The transmissivity ranges allows for tolerance variations with respect to transmissive members correlated to the same characteristic, and can be pre-calibrated during manufacture. Multiple samples of a reference transmissive member (i.e., transmissive members of the same kind having substantially the same transmissivity to be corresponded to a common characteristic) are measured for transmissivity to determine a transmissivity range for such kind of transmissive member. In this way, a transmissivity range and a corresponding characteristic is prepared and stored for each kind of transmissive member. In order for a transmissive member to match a particular characteristic, it must stay within the boundary provided by one of the stored transmissivity ranges. It should be appreciated that testing of transmissive members to obtain different transmissivity ranges is performed using the same type or structure of optical sensor used by image forming device 100.

The number of table records and the predetermined transmissivity values and corresponding characteristics may be determined empirically and are not limited to the example values illustrated above. For example, the table may include more or fewer table records, and other example embodiments may include different predetermined transmissivity values/ranges and corresponding toner cartridge characteristics than those depicted above.

In another example embodiment, toner cartridge 200 may include multiple transmissive members 240, such as for example on positioning guide 228, with each transmissive member being encoded with a distinct characteristic based on the amount of transmissivity. For example, a first transmissive member having a first transmissivity may indicate a first characteristic of toner cartridge 200, and a second transmissive member having a second transmissivity may indicate a second characteristic of toner cartridge 200. Controller 102 may access different lookup tables T to determine the first and second characteristics. For example, based on the position or location of a transmissive member, a table address pointer may be provided to specify which lookup table T to access.

Figure 11A:
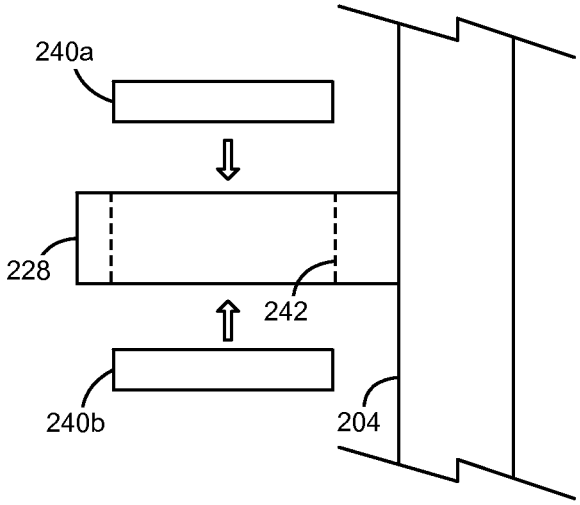
FIGS. 11A-11B illustrate the positioning guide including multiple transmissive members populated on a single aperture according to one example embodiment.
Figure 11B:
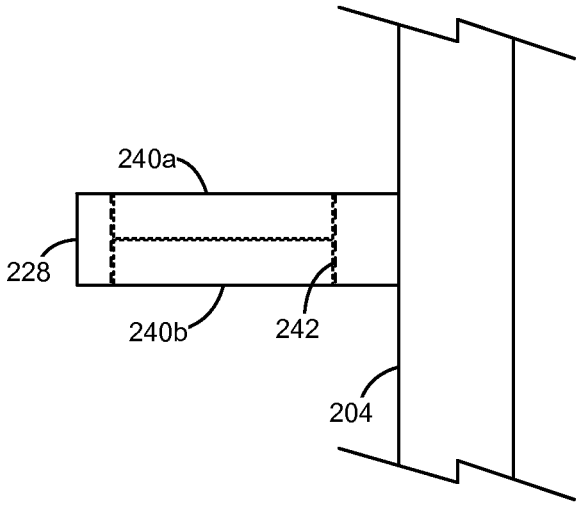

In another example embodiment, multiple transmissive members may be positioned in a stacked arrangement along a single aperture on positioning guide 228. For example, with reference to FIGS. 11A-11B, two transmissive members 240*a*, 240*b* are positioned on opposed sides of positioning guide 228 and/or are sandwiched together to form a stack of transmissive members along aperture 242, resulting in a net transmissivity through aperture 242 equal to a product of the individual transmissivities of transmissive members 240*a*, 240*b*. By using multiple transmissive members in a stacked arrangement, various possible net transmissivity values may be obtained for indicating characteristics relating to toner cartridge 200. For example, where there are two types of transmissive members having two different transmissivities and two transmissive members 240*a*, 240*b* are stacked together, four net transmissivity values are available for indicating characteristics of toner cartridge 200. Generally, where N types of transmissive members having N different transmissivities are arranged in a stack of X transmissive members, $X^N$ possible net transmissivity values are available for use. This example embodiment can provide relatively fewer unique components to manage which can be advantageous for manufacturing.

In one example embodiment, transmissivity of a transmissive member 240 may be measured as a relative measurement obtained by measuring an amount of optical energy received by receiver 432 with the absence of the transmissive member 240 and the amount of optical energy received by receiver 432 when the transmissive member 240 is between transmitter 431 and receiver 432. For example, a baseline measurement reading may be obtained by emitting optical energy along the optical path from transmitter 431 to receiver 432 while no toner cartridge 200 is inserted in tray 400. When a toner cartridge is inserted in tray 400 and transmissive member 240 moves into the optical path of optical sensor 430, optical energy collected by receiver 432 may correspond to an actual measurement reading. A ratio between the actual measurement and the baseline measurement readings may be used to determine transmissivity of transmissive member 240. For example, transmissivity may be determined using a mathematical relationship: T=Y/X; where T corresponds to transmissivity, Y corresponds to the actual measurement reading and X corresponds to the baseline measurement reading. As an example, consider a baseline measurement reading having some trivial output of about 10 volts and an actual measurement reading of about 8 volts. In terms of percentage, transmissivity of the transmissive member is about 80%. Alternatively, actual measurement reading may be directly correlated to a transmissivity value and a corresponding characteristic, in other example embodiments. It is also contemplated that other forms for representing transmissivity may be used.

According to another example embodiment, characteristics associated with a toner cartridge 200 may be determined via a sequence of transmissivity patterns. For example, with reference to FIGS. 12A and 12B, positioning guides 228A-228D each includes a plurality of transmissive members 240(1), 240(2), . . . , 240(N), where N is the total number of transmissive members on a corresponding positioning guide 228. The placement of transmissive members 240(1), 240(2), . . . , 240(N) can be provided such that each transmissive member 240(*n*) sequentially passes through optical sensor 430 upon insertion of the toner cartridge 200 in the direction 205A. In this example, optical sensor 430 is located in a position that would allow each transmissive member 240(*n*) to pass through the optical path of optical sensor 430 before toner cartridge 200 reaches its final position in tray 400. Each transmissive member 240(*n*) is appropriately sized to allow detection by optical sensor 430. Additionally, in the example shown, the first transmissive member 240(1) and a last transmissive member 240(N) positioned at the beginning and end of the sequence of transmissive members, respectively, are provided for checking a start and an end, respectively, of a measurement reading.

When toner cartridge 200 is inserted in tray 400 in the direction 205A, optical sensor 430 reads each transmissive member 240(*n*) and provides signals to controller 102 based on the amount of optical energy received by receiver 432. Accordingly, information collected by controller 102 depends upon an absence or a presence of a transmissive member 240(*n*) on positioning guide 228. In particular, the output of optical sensor 430 varies depending on the portion of positioning guide 228 moving into the optical path of optical sensor 430, and upon the intensity of optical energy received by receiver 432. For example, when an opaque region, such as regions between adjacent transmissive members, moves into the optical path, the optical energy from transmitter 431 is blocked resulting in the receiver not receiving optical energy (or close to null) and providing relatively low sensor output. When a transmissive member 240(*n*) moves into the optical path, some fraction of the optical energy emitted by transmitter 431 passes through the transmissive member 240(*n*) depending on its transmissivity and is received by receiver 432 resulting in an increase in sensor output. In another example, in a case where positioning guide 228 is provided as a transluscent or transparent member and transmissive members 240(*n*) are portions of the translucent or transparent positioning guide with modified (e.g., lower) transmissivities, optical energy that reaches receiver 432 would be relatively greater when regions between adjacent transmissive members 240(*n*) move into the optical path than when transmissive members 240(*n*) move into the optical path. In this example, signal output of the optical sensor may be relatively high except in areas where transmissive members 240(*n*) would act as interrupters and lower the signal output. Ultimately, positioning guide 228 either blocks at least some fraction of the optical energy from transmitter 431 or causes at least some fraction of the optical energy to be received by receiver 432, causing generation of a signal pattern.

FIGS. 13A and 13B show example signal patterns generated when transmissive members 240(1), 240(2), . . . , 240(N) with substantially opaque regions therebetween in each of positioning guides 228A-228D illustrated in FIGS. 12A-12B move into the optical path of optical sensor 430 upon insertion of toner cartridge 200 into tray 400. Signals SIG_A and SIG_B represent signals generated when passing positioning guides 228A and 228B through the optical path of optical sensor 430, respectively, and signals SIG_C and SIG_D represent signals generated when passing positioning guides 228C and 228D through the optical path, respectively. The signal patterns include low signal output levels in which no (or relatively close to zero) optical energy is received by receiver 432 from transmitter 431 due to absence of a transmissive member along the optical path, and high output signal levels shown as pulses P(n) in which at least some fraction of the optical energy emitted by transmitter 431 is received by receiver 432 due to presence of transmissive members 240 on the positioning guides 228. Thus, the number of high output signal levels depend upon the number of transmissive members along a positioning guide 228. A counter (not shown) may be used to count the number of high signal output levels. As will be appreciated, alternative embodiments may incorporate sensor circuitries which generate output that transitions from a high value to a low value as more optical energy is received by receiver 432.

In FIG. 12A, positioning guide 228A has 10 transmissive members resulting in 10 high output signal levels in signal SIG_A, while positioning guide 228B has 6 transmissive members resulting in 6 high output levels in signal SIG_B. In these examples, the first high output signal P(1) and last high output signal P(N) for each signal SIG_A and SIG_B correspond to signals generated when transmissive members 240(1), 240(N), respectively, move into the optical path of optical sensor 430 to indicate start and end of measurement reading, respectively. In an example embodiment, the number of high output signal levels occurring between the first and last high output signal levels P(1), P(N) (corresponding to the number of intermediate transmissive members 240(2) to 240(N−1) in the sequence) may be used to determine a characteristic associated with the toner cartridge. In this example, controller 102 may access another lookup table T2 (FIG. 10) which includes a plurality of table records, each table record including a predetermined count value and a corresponding toner cartridge characteristic. An example lookup table showing predetermined count values and corresponding characteristics is illustrated in Table 2.

TABLE 2

| Number of Transmissive Members and Characteristic | |
|---|---|
| Predetermined Count Value | Toner Cartridge Characteristic |
| 1-3 | Low Yield |
| 4-6 | Standard Yield |
| 7-9 | High Yield |

The predetermined count value corresponds to the number of intermediate transmissive members 240(2) to 240(N−1). Toner cartridge characteristics, in this example, include different toner capacities of a toner cartridge, such as for example, low yield, standard yield, and high yield. Accordingly, toner capacity of toner cartridge 200 can be determined based on the number of intermediate transmissive members detected. As an example, if 8 intermediate transmissive members are detected as in the case with positioning guide 228A, then the toner cartridge can be identified as being a high yield toner cartridge, and if 4 intermediate transmissive members are detected as in the case with positioning guide 228B, then the toner cartridge can be identified as being a standard yield cartridge. As a result, Table 2 provides a reference for determining a characteristic of the toner cartridge 200 using the number of transmissive members detected. As with Table 1, the number of table records in Table 2 and values therein are not limited to the example values illustrated above, and thus can include different count values and corresponding toner cartridge characteristics.

In another example embodiment, individual transmissivity of the transmissive members 240(1), 240(2), . . . , 240(N) may be determined by controller 102, and thereafter used to determine a characteristic associated with the toner cartridge 200. For example, transmissive members 240(1), 240(2), . . . , 240(N) may have substantially the same transmissivity. Positioning guides 228A and 228B in FIG. 12A show such examples whereby corresponding signal patterns SIG_A, SIG_B show high output signal levels that are substantially of the same voltage level indicating a substantially common transmissivity (about 75% in the example shown). The common transmissivity may be used to determine a characteristic of the toner cartridge, such as by using Table 1. Alternatively, an integrated transmissivity value may be calculated by determining an average of the determined transmissivities, and such integrated transmissivity value may be used to determine a toner cartridge characteristic. In this example embodiment, the number of transmissive members 240 can be used to provide a first characteristic of the toner cartridge 200 and the common/integrated transmissivity can be encoded with a second characteristic of the toner cartridge 200.

In another example embodiment, the sequence of transmissive members 240(1), 240(2), . . . , 240(N) may have varying transmissivities. For example, in FIG. 12B, each of positioning guides 228C and 228D include transmissive members 240(1)-240(6) having different transmissivities as depicted by the varying voltage levels of corresponding signal patterns SIG_C and SIG_D, respectively, in FIG. 13B. In this example, controller 102 may access another stored lookup table including a plurality of table records, each table record arrayed with a combination of transmissivity values and a corresponding toner cartridge characteristic. As an example, positioning guide 228C includes intermediate transmissive members 240(2), 240(3), 240(4), 240(5) having transmissivities of about 50%, 10%, 50%, 25%, respectively, while positioning guide 228D include intermediate transmissive members 240(2), 240(3), 240(4), 240(5) having transmissivities of about 10%, 25%, 10%, 50%, respectively. For each combination of transmissivity values measured from a positioning guide 228, controller 102 may determine a corresponding characteristic associated with the toner cartridge using a stored lookup table.

In another example embodiment, transmissivity of at least one of the transmissive members 240(1), 240(2), . . . , 240(N) may be used to determine one or more characteristics relating to toner cartridge 200. Accordingly, each transmissive member 240 can be encoded with a characteristic based on the amount of transmissivity. In still another example embodiment, combinations of at least two transmissive members, or an average transmissivity thereof, may be used to determine other characteristics relating to toner cartridge 200.

The example embodiments illustrated in FIG. 12B show four intermediate transmissive members 240(2), 240(3), 240(4), 240(5) that are used for conveying information relating to toner cartridge 200. It will be appreciated, however, that any number of transmissive members and different transmissivity combinations thereof may be used. Increasing the number of transmissive members may provide the opportunity to use more possible combinations for specifying information relating to toner cartridge 200. Further, the above example embodiments illustrate the use of intermediate transmissive members of substantially the same size and uniform spacing. However, it is understood that transmissive members of differing sizes or shapes can be used, and other patterns, positioning or spacing between transmissive members may be implemented, to provide more flexibility and more possible combinations for specifying information relating to toner cartridge 200. Additionally, one or more passive or active wiper features (not shown) may be disposed along loading rail 418 upstream of the optical sensor, relative to the direction of insertion of toner cartridge 200 into image forming device 100, for cleaning the optical surfaces of the transmissive member(s) prior to being read by the optical sensor. A plurality of lookup tables including different transmissivity values or other parameters derived therefrom and corresponding characteristics or information relating to toner cartridge 200, may be provided and stored in memory 103. Controller 102 may utilize a plurality of table address pointers for specifying which lookup table to access.

In one example embodiment, a detected transmissivity of a transmissive member may be used for verifying authenticity of a toner cartridge 200. In this example, toner cartridge 200 may communicate with image forming device 100 certain information associated therewith, such as an electrical signature stored in a smart chip or memory device mounted on toner cartridge 200, upon installation thereof in image forming device 100. Controller 102 may detect transmissivity of a transmissive member on toner cartridge 200, and use the detected transmissivity to determine an electrical signature corresponding to a particular characteristic. If the stored electrical signature corresponds with the electrical signature ascertained from the detected transmissivity, toner cartridge 200 may be verified as authentic. Otherwise, toner cartridge 200 may be identified as unauthentic or invalid and image forming device 100 can act accordingly such as by providing an error message or other predetermined action. In another example, authenticity of toner cartridge 200 may be determined based on whether the detected transmissivity falls within a stored predetermined transmissivity range, such as those provided in Table 1. That is, if the detected transmissivity does not fall within any of the predetermined transmissivity ranges, the toner cartridge 200 may be tagged as unauthentic or invalid.

Information ascertained from detected transmissivity of transmissive members may also be used to verify that a correct toner cartridge 200 with a particular toner color/type is installed, and/or to prevent a wrong toner cartridge 200 from being inserted into tray 400. For example, where each toner cartridge 200 provides a different color toner, such as where toner cartridges having black, cyan, yellow and magenta toners are used, a color type of a toner cartridge 200 ascertained from the detected transmissivity may be used to prevent each toner cartridge 200 from being inserted into the tray 400 corresponding with any other color. As an example, where a toner cartridge 200 is determined to contain black colored toner based on a detected transmissivity, controller 102 may compare whether the color type of the toner cartridge 200 matches with a color type required by the tray 400 in which the toner cartridge 200 is inserted. If not, image forming device 100 may provide an error feedback message indicating installation of the toner cartridge 200 in a wrong tray and provide instructions to correct the error. In an alternative example embodiment, the location of optical sensor 430 along positioning guide 228 can also be varied for each tray 400 in order to prevent a toner cartridge 200 from being read by the optical sensor 430 unless its transmissive member coincides with the location of the optical sensor 430. These example embodiments provide an alternative to providing matching keying structures between tray 400 and toner cartridge 200 that are typically used to prevent a toner cartridge from being inserted into a wrong tray.

Optical sensor 430 may be calibrated to compensate for design tolerances, sensitivity variations, and the like. For example, optical energy may be directed onto receiver 432 without any interruption or obstruction, such as when toner cartridge 200 is not inserted in tray 400, to produce an output voltage. If the output voltage is below a predetermined threshold, controller 102 may adjust the signal for driving transmitter 431 such that the output voltage corresponds to a desired voltage output. As will be appreciated, other methods for calibrating optical sensor 430 may be used as are known in the art.

In an example embodiment, an independent power source 107 (FIG. 10) may be provided to allow calibration, as well as measurement readings on transmissive members 240 on toner cartridge 200, to be performed even when image forming device 100 is powered off or disconnected from the AC mains. For example, independent power source 107 may include a rechargeable battery, wireless charging devices which convert electromagnetic energy of radio signals into electrical power, or other power generating devices to provide power to controller 102. In one example, controller 102 may receive power from power source 107, and transfer power to optical sensor 430 through wires electrically coupling it to controller 102. In another example, optical sensor 430 can receive power directly from power source 107. Use of additional circuitries on board may also be used to convert electrical power into forms suitable for use by controller 102 and/or optical sensor 430.

Figure 14:
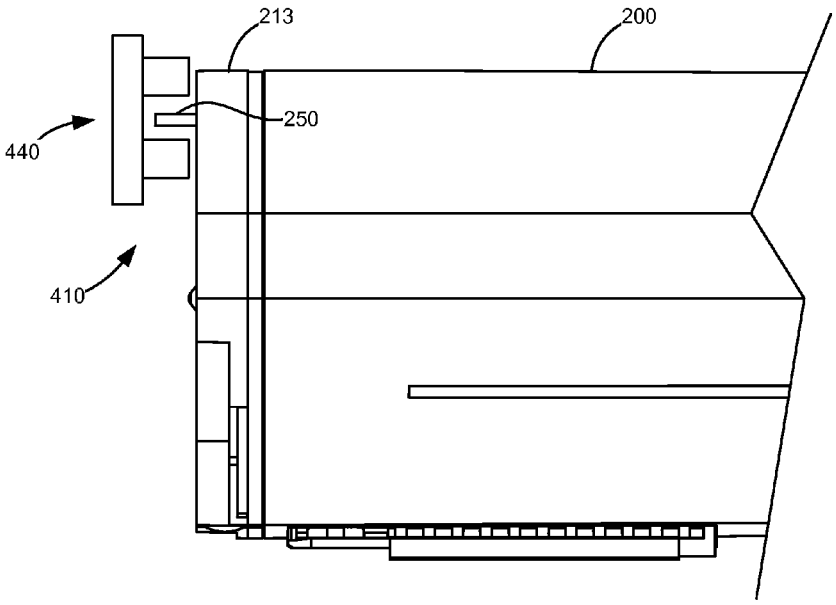
FIG. 14 is a side view of the toner cartridge illustrating a transmissive member protruding from an end cap of the toner cartridge according to one example embodiment.

FIG. 14 shows another optically readable feature and sensor arrangement, according to another example embodiment. As shown, a transmissive member 250 (also shown in phantom lines in FIG. 7) protrudes from the outer surface of end cap 213, and an optical sensor 440 is disposed at the rear end 410 of cartridge storage area 402. Transmissive member 250 is positioned to move into an optical path of optical sensor 440 as toner cartridge 200 reaches its final position in tray 400, and optical sensor 440 is operative to measure transmissivity of transmissive member 250. As will be appreciated, transmissive member 250 may be disposed on other positions on the exterior of housing 203, and a corresponding optical sensor may be disposed within image forming device 100 to coincide with the location of the transmissive member 250 upon insertion of toner cartridge 200 in tray 400.

Figure 15:
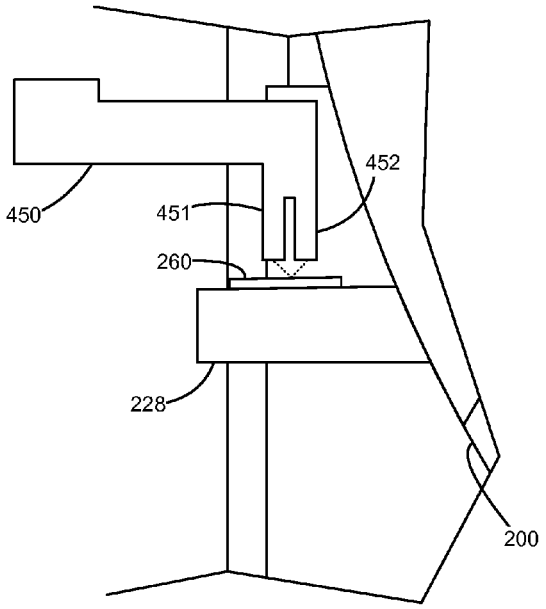
FIG. 15 illustrates a reflective member disposed on the positioning guide of the toner cartridge according to one example embodiment.

The above example embodiments have been described with respect to utilizing transmissivity of optically readable features to provide information relating to characteristics of toner cartridge 200. According to another example embodiment, reflectivity of an optically readable feature may also be used, in lieu of or in addition to using transmissivity, to provide such information. For example, in FIG. 15, a reflective member 260 is disposed on positioning guide 228. Reflective member 260 can be constructed using different combinations of materials to modify reflectivity and to exhibit substantial reflectivity to light in the ultraviolet, visible, or infrared regions of the electromagnetic spectrum. Reflective member 260 is readable by an optical sensor 450 disposed along loading rail 418. Optical sensor 450 includes an emitter 451 which emits optical energy to reflective member 260, and a corresponding detector 452 that receives an amount of the optical energy reflected by reflective member 260. An output signal corresponding to the optical energy received by detector 452 may then be used by controller 102 to determine reflectivity of the reflective member 260 and, thereafter, determine at least one characteristic associated with toner cartridge 200 based on the determined reflectivity. Controller 102 may access one or more stored lookup tables in performing the determinations, with each stored lookup table including reflectivity values and corresponding characteristics, in a similar manner as described above with respect to using transmissive members.

In other example embodiments, positioning guide 228 may include multiple reflective members having the same or different reflectivities, wherein the amount of reflectivity of each reflective member, or combinations of reflectivity values, indicate at least one characteristic of toner cartridge 200, such as in a similar manner described above with respect to using multiple or sequence of transmissive members.

Figure 16:
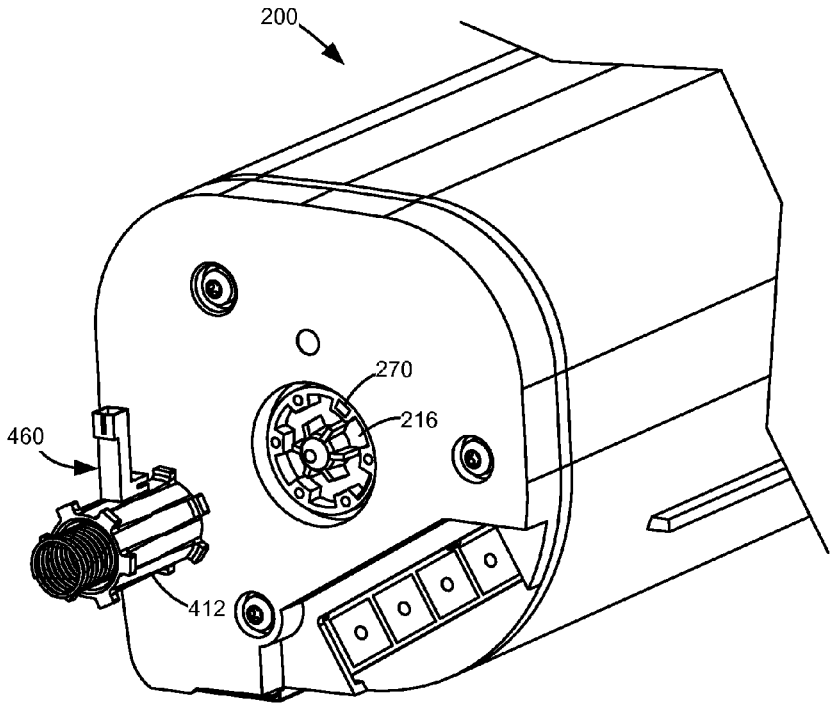
FIG. 16 is a perspective view illustrating a reflective member disposed on a drive element of the toner cartridge according to one example embodiment.
Figure 17:
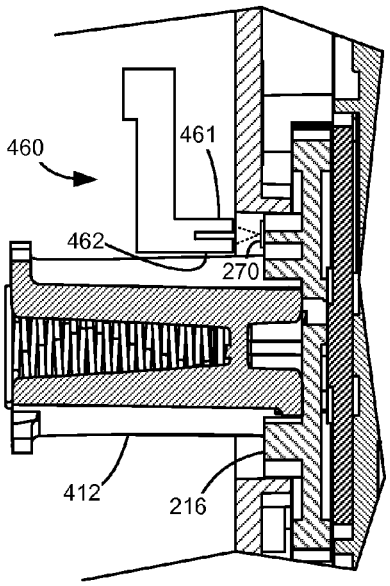
FIG. 17 is a cross-sectional view of the toner cartridge shown in FIG. 16 with the reflective member positioned adjacent an optical sensor according to one example embodiment.

FIGS. 16-17 show another example of using reflectivity of an optically readable feature on toner cartridge 200 to convey information relating to toner cartridge 200. A reflective member 270 is disposed on drive element 216 of toner cartridge 200, and an optical sensor 460 is positioned at the rear end 410 of cartridge storage area 402 adjacent to drive element 412. When toner cartridge 200 reaches its final position in tray 400, drive element 216 mates with corresponding drive element 412 to receive rotational power. Thus, drive element 216 is rotatable by drive element 412 and reflective member 260 can be aligned with optical sensor 460 in order to be measured. For example, in FIG. 17, drive element 412 rotates drive element 216 such that reflective member 270 is positioned in front of optical sensor 460. An emitter 461 of optical sensor 460 emits optical energy toward reflective member 260, which in turn reflects a portion of the optical energy toward a detector 461 of optical sensor 460. Controller 102 may then determine reflectivity of reflective member 270 based on the output signal of detector 462, and a corresponding toner cartridge characteristic may be identified based on the determined reflectivity.

In other example embodiments, the transmissive members and reflective members described herein may be embodied as an optically encoded surface or member that has both a characteristic transmissivity and reflectivity. For example, the optically encoded member may comprise a coating that is partially transmissive and partially reflective such that the optically encoded member can permit some fraction of optical energy to pass therethrough to be received by a first optical sensor, and/or another fraction of the optical energy to be reflected by the encoded member and received by a second optical sensor. At least one of the transmissivity and reflectivity of the encoded surface may be determined based on the optical energy transmitted through and reflected by the encoded member, respectively, and thereafter used to determine a characteristic associated with the toner cartridge.

With the above example embodiments, information regarding toner cartridge 200 can be conveyed to image forming device 100 using optically readable features and, potentially, without the use of expensive smart chips and other memory devices. Supplies security can also be enhanced to protect against the use of unauthentic toner cartridges, and thereby optimize performance of and/or prevent damage to the image forming device. Further, the descriptions of the details of the example embodiments have been described using toner cartridges used in an electrophotographic imaging device. However, it will be appreciated that the teachings and concepts provided herein are applicable to other replaceable units of image forming device 100 as well as other types of image forming devices, such as inkjet imaging devices, 3D printers, and other electronic devices.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an image forming apparatus, comprising:

a housing; and at least one transmissive member positioned on an exterior of the housing for receiving optical energy from the image forming apparatus, the at least one transmissive member composed of a transmissive material that allows a fraction of the optical energy to pass through the transmissive material modifying an amount of the optical energy that leaves the at least one transmissive member relative to an amount of the optical energy received by the at least one transmissive member, the fraction of the optical energy that passes through the transmissive material relative to the amount of the optical energy received by the transmissive material defines a transmissivity percentage value of the at least one transmissive member;

wherein the transmissivity percentage value of the at least one transmissive member indicates a characteristic of the replaceable unit.

2. The replaceable unit of claim 1, wherein a number of the at least one transmissive member positioned on the exterior of the housing indicates a characteristic of the replaceable unit.

3. The replaceable unit of claim 1, further comprising a positioning guide on the exterior of the housing that aligns the replaceable unit when the replaceable unit is installed in the image forming device, wherein the at least one transmissive member is positioned along the positioning guide.

4. The replaceable unit of claim 3, wherein the at least one transmissive member includes a plurality of transmissive members disposed on the positioning guide.

5. The replaceable unit of claim 4, wherein the plurality of transmissive members are substantially of uniform width along a direction of insertion of the replaceable unit into the image forming apparatus.

6. The replaceable unit of claim 4, wherein a number of the plurality of transmissive members on the positioning guide indicates a characteristic of the replaceable unit.

7. The replaceable unit of claim 1, further comprising a rotatable drive element on the exterior of the housing, the at least one transmissive member being disposed on the drive element.

8. The replaceable unit of claim 1, further comprising an end cap coupled to a longitudinal end of the housing, wherein the at least one transmissive member is disposed on the end cap.

9. The replaceable unit of claim 1, further comprising a memory device on the housing having stored therein an electrical signature corresponding with the transmissivity percentage value of the at least one transmissive member.

10. A container for ink or toner, the container installable in an image forming device having an optical sensor, the optical sensor including a transmitter that emits optical energy along an optical path and a receiver positioned to receive the optical energy, the container comprising:

a housing having a reservoir for holding ink or toner; and at least one transmissive member positioned on an exterior of the housing, the at least one transmissive member is unobstructed and positionable in the optical path when the container is installed in the image forming device, the at least one transmissive member is composed of a transmissive material that allows a fraction of the optical energy to pass through the transmissive material relative to an amount of the optical energy received by the transmissive material, the fraction of the optical energy that passes through the transmissive material relative to the amount of the optical energy received by the transmissive material defines a transmissivity percentage value of the at least one transmissive member;

wherein a characteristic of the container is encoded in the transmissivity percentage value of the at least one transmissive member such that the characteristic is determined by comparing the transmissivity percentage value of the at least one transmissive member with a plurality of predetermined transmissivity percentage values and a corresponding plurality of possible characteristics.

11. The container of claim 10, further comprising a positioning guide on the exterior of the housing that aligns the container when the container is installed in the image forming device, the at least one transmissive member disposed on the positioning guide.

12. The container of claim 11, wherein the at least one transmissive member is provided as an insert to the positioning guide.

13. The container of claim 11, wherein the at least one transmissive member is formed integral to the positioning guide.

14. The container of claim 10, further comprising a memory device on the housing having stored therein an electrical signature corresponding with the transmissivity percentage value of the at least one transmissive member.

15. In an image forming device in which a replaceable unit containing ink or toner is installable in the image forming device to supply ink or toner thereto for use in image formation, a system for determining at least one characteristic of the replaceable unit, the system comprising:

an optical sensor including a transmitter that emits optical energy along an optical path and a receiver positioned to receive the optical energy;

at least one transmissive member positioned on an exterior of a housing of the replaceable unit, the at least one transmissive member is positioned in the optical path when the replaceable unit is installed in the image forming device and composed of a transmissive material that allows a fraction of the optical energy to pass through the transmissive material relative to an amount of the optical energy received by the transmissive material such that the at least one transmissive member changes an amount of the optical energy received by the receiver relative to an amount of the optical energy emitted by the transmitter, the fraction of the optical energy that passes through the transmissive material relative to the amount of the optical energy received by the transmissive material defines a transmissivity percentage value of the at least one transmissive member; and a controller communicatively coupled to the optical sensor, the controller operative to determine at least one characteristic of the replaceable unit by comparing the transmissivity percentage value of the at least one transmissive member with a plurality of predetermined transmissivity percentage values and a corresponding plurality of possible characteristics.

16. The system of claim 15, further comprising a positioning guide extending along a lengthwise dimension of the housing corresponding to a direction of insertion thereof into the image forming device, the at least one transmissive member positioned on the positioning guide.

17. The system of claim 16, further comprising a storage area for the replaceable unit and a loading rail running along a length of the storage area for engaging the positioning guide, wherein the optical sensor is disposed at a location on the loading rail such that the at least one transmissive member moves into the optical path when the replaceable unit is installed in the image forming device.

18. The system of claim 15, wherein the controller is further operative to authenticate the replaceable unit based at least in part upon the determined at least one characteristic.

19. The system of claim 15, wherein the controller is further operative to verify correct installation of the replaceable unit in the image forming device based at least in part upon the determined at least one characteristic.

20. The system of claim 15, further comprising an independent power source coupled to at least one of the controller and the optical sensor for providing power thereto.

* * * * *